US011019869B1

(12) United States Patent
Cozzone et al.

(10) Patent No.: US 11,019,869 B1
(45) Date of Patent: Jun. 1, 2021

(54) SAFETY APPARATUS FOR USE WITH A HELMET

(71) Applicants: David Cozzone, Manahawkin, NJ (US); Richard Shenowski, Bordentown, NJ (US); Veronica Janice, Shamong, NJ (US); Aaron Szymanski, Watertown, CT (US); Mohan Rajasekaran, Watertown, CT (US); Stacey Simmons, Cynthiana, KY (US)

(72) Inventors: David Cozzone, Manahawkin, NJ (US); Richard Shenowski, Bordentown, NJ (US); Veronica Janice, Shamong, NJ (US); Aaron Szymanski, Watertown, CT (US); Mohan Rajasekaran, Watertown, CT (US); Stacey Simmons, Cynthiana, KY (US)

( * ) Notice: Subject to any disclaimer, the term of this patent is extended or adjusted under 35 U.S.C. 154(b) by 0 days.

(21) Appl. No.: 16/833,392

(22) Filed: Mar. 27, 2020

(51) Int. Cl.
*A42B 3/04* (2006.01)

(52) U.S. Cl.
CPC ..... *A42B 3/044* (2013.01); *A42B 3/0453* (2013.01)

(58) Field of Classification Search
CPC ..... A42B 3/044; A42B 3/0453; A42B 3/0446; A41D 13/01; F21V 21/0816; F21V 21/084; F21V 21/088; F21V 21/0885
See application file for complete search history.

(56) References Cited

U.S. PATENT DOCUMENTS

| | | | | |
|---|---|---|---|---|
| 4,523,258 | A * | 6/1985 | Morse | F21V 33/0008 362/108 |
| 8,529,082 | B1 | 9/2013 | Baker et al. | |
| 9,103,539 | B2 | 8/2015 | Baker et al. | |
| 9,737,105 | B2 | 8/2017 | Baker et al. | |
| 9,775,391 | B1 * | 10/2017 | Gonzalez | F21V 33/0076 |
| 9,986,778 | B2 | 6/2018 | Baker et al. | |
| 10,561,188 | B2 | 2/2020 | Baker et al. | |
| 10,859,245 | B2 * | 12/2020 | Gall | H05B 47/10 |
| 2009/0074367 | A1 | 5/2009 | Wainright | |
| 2017/0238642 | A1 * | 8/2017 | Tatum | A42B 3/044 |
| 2017/0276856 | A1 * | 9/2017 | Gagneux | F21V 21/0816 |
| 2019/0350292 | A1 * | 11/2019 | Maldonado | A42B 3/044 |
| 2019/0390845 | A1 * | 12/2019 | Ljunggren | F21V 21/145 |
| 2020/0068976 | A1 * | 3/2020 | Ross | F21L 4/02 |
| 2020/0154811 | A1 * | 5/2020 | Hyma | A42B 3/044 |
| 2020/0248896 | A1 * | 8/2020 | Gall | H05B 47/10 |

* cited by examiner

*Primary Examiner* — Joseph L Williams
*Assistant Examiner* — Jose M Diaz
(74) *Attorney, Agent, or Firm* — Howson & Howson LLP

(57) ABSTRACT

For improved visibility of an individual wearing a helmet to which a personal headlamp is attached by an adjustable band, a flexible strip carrying a series of light-emitting devices and/or reflectors is removably attached to the adjustable band by means of connectors which are adjustably movable along at least a portion of the length of the band. The light-emitting devices are supplied with power from the same electrochemical power source that operates the headlamp but controlled independently of the headlamp.

18 Claims, 5 Drawing Sheets

SAFETY APPARATUS FOR USE WITH A HELMET

FIELD OF THE INVENTION

This invention relates to a safety apparatus, and more particularly to a device for attachment to a hard hat or similar helmet to provide illumination for the wearer's use and also improve the visibility of the wearer to others at night or while the wearer is in a dark environment such as a tunnel or a mine.

BACKGROUND OF THE INVENTION

Improvement of the visibility of an individual wearing a helmet can be achieved by the attachment of light emitting devices such as LEDs or reflectors, or preferably, both, to the helmet. It would be convenient to attach the light emitting devices, reflectors, or both, to the helmet by affixing them to a band that extends around the perimeter of the helmet, for example, a band that supports a personal headlamp arranged to project a beam of light forward from the helmet to illuminate objects in the wearer's field of vision.

A problem with the attachment of light emitting devices or reflectors, particularly elongated reflectors, to a headlamp band is that the length of the band needs to be adjusted in order to secure the headlamp to the helmet. In addition, for effective tightening of the headlamp band around the perimeter of a helmet, the band should have some stretchability and resilience. Wires or other electrical conductors that supply current to the light emitting devices will interfere with adjustment of the length of the headlamp band and with stretching of the band, especially if they are incorporated into the interior of the band to reduce the risk of damage. Similarly, elongated reflectors secured to the exterior of the band will interfere with adjustment and stretching of the band.

SUMMARY OF THE INVENTION

The invention addresses the above problems by providing light emitting devices, and/or reflectors, on an external flexible strip which is attached to the headlamp band by connectors that can be adjusted by movement along the length of the headlamp band. At least one of the connectors is preferably provided with a clip that allows the flexible strip to be at least partly detached from the headlamp band for more convenient packaging and storage.

The light emitters on the flexible strip can be powered by the same power source that supplies electrical current to the headlamp, typically an electrochemical power supply inside the headlamp housing. However, separate switches are preferably provided so that the headlamp and the light emitters on the flexible strip can be operated independently. The switch for operating the light emitters on the flexible strip is preferably mounted on the flexible strip.

A safety apparatus in accordance with one aspect of the invention comprises a headlamp assembly including a housing and a light emitting device mounted in the housing. A band comprising a loop of flexible material is connected to the housing and adapted to surround a helmet, e.g., a hard hat at least partially in order to support the headlamp assembly on the helmet. The length of the band is adjustable in order to tighten the band about the helmet. An elongated flexible strip having a substantially fixed length, and having light emitting elements, light reflecting elements, or both, at spaced locations along its length, extends along a part of the length of the headlamp-supporting band. The flexible strip is connected to the band at a plurality of locations along the length of the strip, at least one of those locations being adjacent an end of the strip. The connection of the elongated strip to the band, at least at the location adjacent an end of the strip includes a connector adjustably movable lengthwise along at least a portion of the length of the band.

Preferably, the headlamp assembly housing contains an electrochemical power supply, and a first switch, connected to the light emitting device and to the power supply, is manually operable to connect the power supply to the light emitting device.

When the elongated flexible strip supports a plurality of light emitting elements spaced from one another along its length, an electrical connection is preferably provided from the plurality of light emitting elements to the electrochemical power supply. This electrical connection includes a second manually operable switch for controlling electrical current from the power supply to the plurality of light emitting elements. Thus, the headlamp and he light emitting elements on the flexible strip can be powered from the same power supply but operated independently. The electrical connections from the power supply to the headlamp and to the light emitters on the flexible strip can include circuits for control of brightness, circuits for causing flashing operation, or both.

The connector that is adjustably movable lengthwise along at least a portion of the length of the band preferably includes a clip that secures the elongated strip to the connector, but allows manual connection of the elongated flexible strip to the connector, and also, preferably, manual disconnection.

In a preferred embodiment, the elongated flexible strip is connected to the band by connectors positioned on the band at locations adjacent, and on opposite sides of, the headlamp assembly housing, and each of these connectors adjustably movable lengthwise along at least a portion of the length of the band.

If light reflecting elements are utilized, they are preferably fixed to the elongated flexible strip at spaced locations along the length of the strip, and each of the reflecting elements is elongated along the direction of the length of the portion of the strip to which it is fixed.

The safety apparatus may include a connecting device engageable with a rear surface of a helmet. When the connecting device is utilized, the band can have first and second portions extending from the headlamp assembly to the connecting device. Each of these first and second portions can be adjustably connected to the connecting device so that the overall length of the band can be adjusted in order to fit the safety apparatus to a helmet. This connecting device can include a clip allowing connection of the elongated strip to connecting device and also allowing disconnection. Disconnection of the flexible strip from the helmet-fitting band, or at least partial disconnection, facilitates packaging of the safety device by allowing the helmet-fitting band and the flexible strip to be folded separately from each other.

DETAILED DESCRIPTION OF THE PREFERRED EMBODIMENTS

Figure 1:
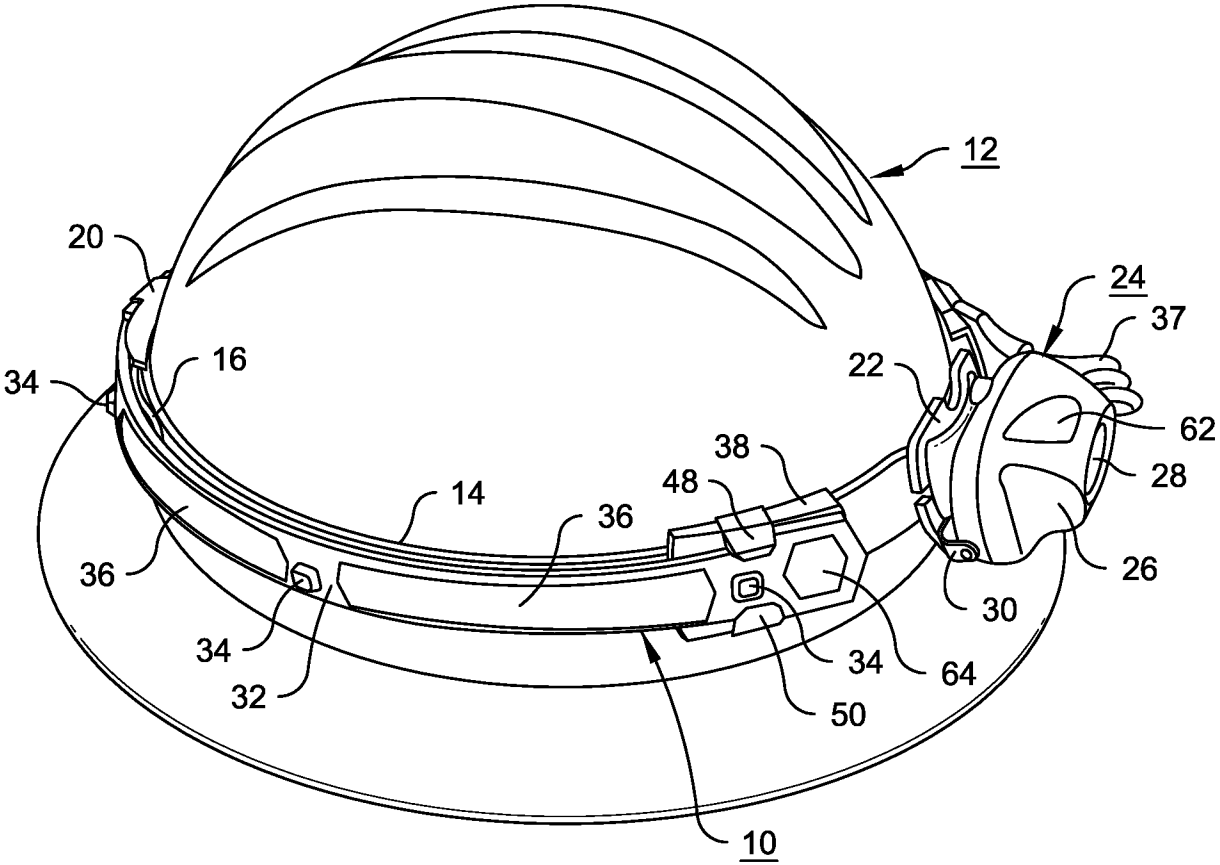
FIG. 1 is a perspective view showing the safety apparatus installed on a helmet.
Figure 2:
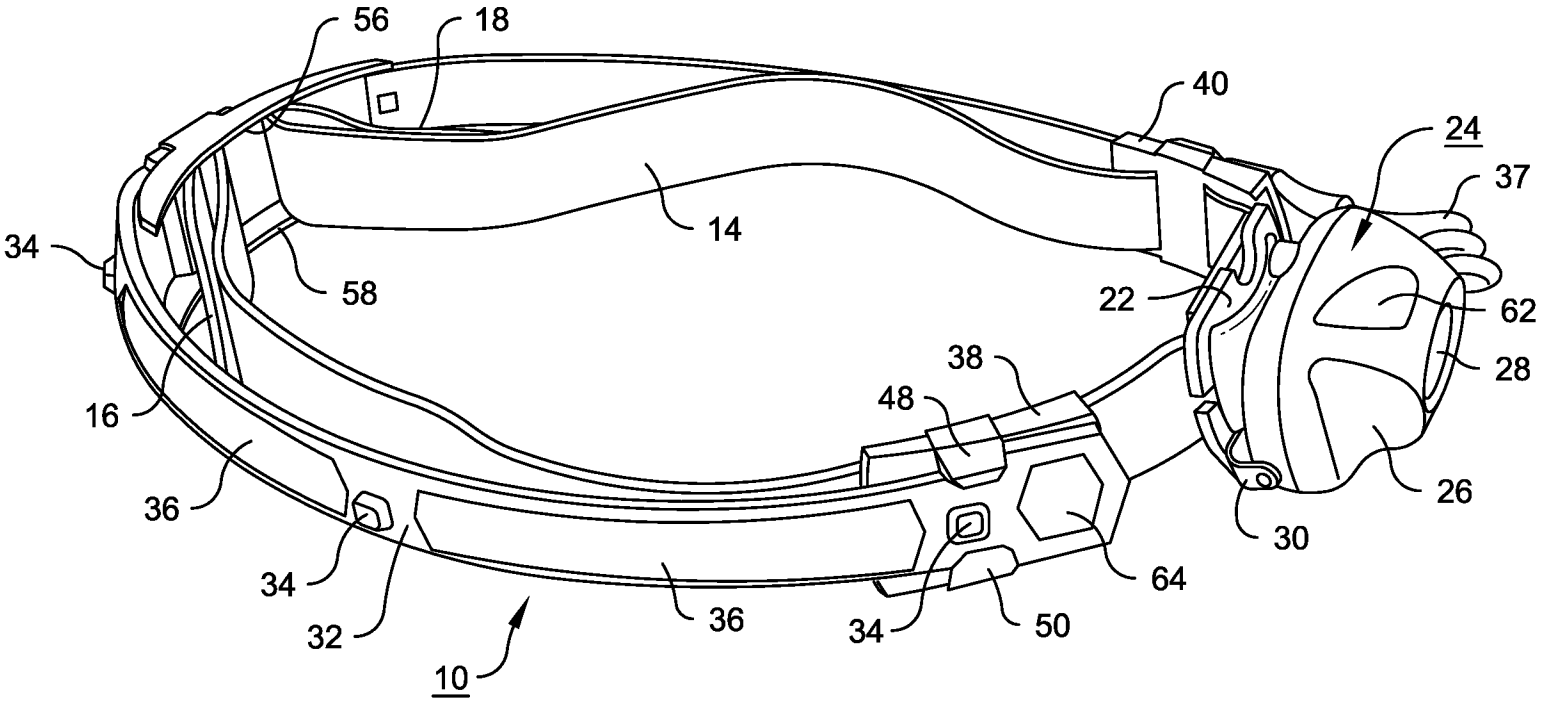
FIG. 2 is a perspective view showing the safety apparatus of the invention removed from the helmet.

As shown in FIG. 1, the safety apparatus 10 is removably installed on a helmet 12. In the example shown, the helmet is a conventional polyethylene hard hat of the kind worn by miners, construction workers, and others requiring protection from head injury. FIG. 2 shows the same safety apparatus 10 removed from the helmet so that details of its structure, hidden by the helmet in FIG. 1, can be seen.

Referring to FIGS. 1 and 2, the safety apparatus comprises a flexible band 14, which is formed into a loop surrounding the helmet at a location a short distance above the brim of the helmet. The band has two end portions 16 and 18, each of which extends through a pair of slots formed in a molded connecting device 20 engageable with a rear surface of the helmet. Each end portion extends rearward through one slot of a pair of adjacent slots and then forward through the other slot of the same pair. The length of the loop can be adjusted by manipulation of the end portions 16 and 18 of the band to tighten the loop and thereby the band to the helmet.

An intermediate portion of the band extends through slots in a headlamp-mounting plate 22 on which is mounted a headlamp assembly 24 comprising a housing 26, a light-emitting device, such as a light-emitting diode (not shown), a lens 28 for concentrating the emitted light into a beam, and a push-button switch for making and breaking an electrical connection between the light emitting device and an electrochemical power supply, which can be a single electrochemical cell, or a battery, inside the housing 26. The housing 26 is preferably mounted on and between a pair of opposed brackets, one of which is bracket 30, to allow tilting adjustment of the headlamp beam.

Except for the connecting device 20, the apparatus described thus far is similar to a conventional personal headlamp of the kind described in U.S. Pat. No. 7,568,812, granted on Aug. 4, 2009. The disclosure of U.S. Pat. No. 7,568,812 is here incorporated by reference. The band 14 is preferably formed of a resilient natural or synthetic rubber that can be stretched in order to exert a tensile force holding the band firmly to the helmet 10 when the ends 16 and 18 of the band are pulled in the slots of the connecting device 20 to tighten the band. Alternatively the band can be made from other stretchable materials, such as a woven fabric and includes stretchable yarns The principal feature that distinguishes the apparatus of the invention from a conventional personal headlamp is an external strip 32, which includes a series of light-emitting devices 34 e.g., light-emitting diodes or LEDs, or a series of elongated light reflecting elements 36, and preferably both. The light emitting devices 34 are preferably, but not necessarily, in alternating, interspersed relationship with the light reflecting elements 36.

Figure 3:
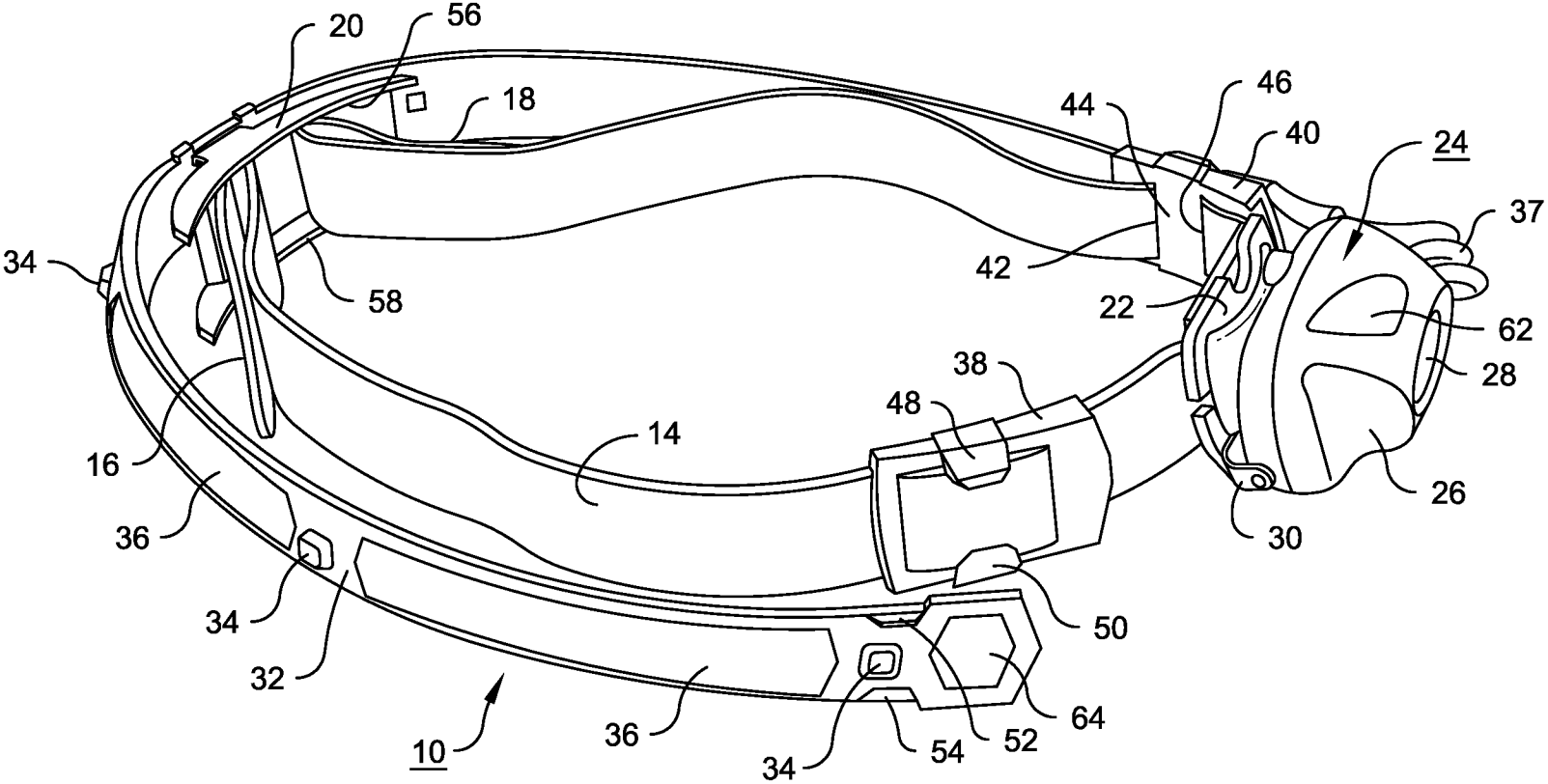
FIG. 3 is a perspective view showing the safety apparatus with its illuminated strip partially removed from the helmet band.
Figure 4:
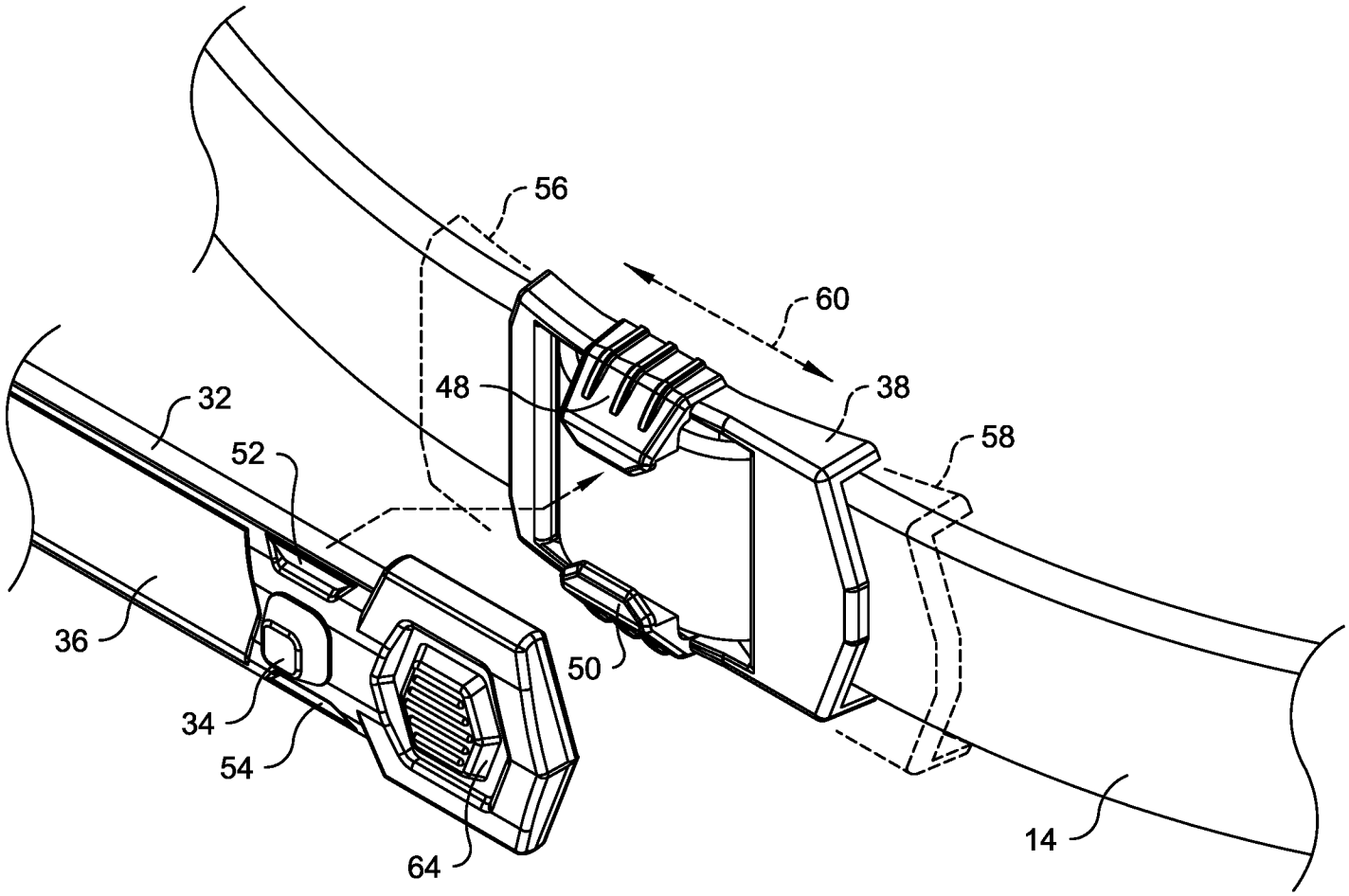
FIG. 4 is a partial perspective view of a portion of the safety apparatus, illustrating how the illuminated strip is engaged with a clip on the helmet band.

The light emitting devices 34 are connected to a power source inside the headlamp assembly 24 through a cable 37, and through conductors (not shown) connected to cable 37 and disposed inside strip 32. Because of the internal conductors, and also because of the reflectors, the strip has very limited stretchability. To allow the flexible band 14 to be adjusted to fit the helmet, the strip 32 is attached to the band 14 in such a way that the band 14 is movable in the direction of its elongation relative to the strip 32. Thus, as shown in FIGS. 2 and 3, clips 38 and 40 are provided on portions of the band 14 at locations near, and on opposite sides of, the headlamp assembly 24. The band 14 extends though slots in these clips in such a way as to allow the band to be moved longitudinally relative to the clips. In other words, the positions of the clips 38 and 40 along the length of the band can be adjusted. As shown in FIG. 3, for example, the band 14 extends into a slot 42 on the back of clip 40, passes behind a wall 44 on the back of the clip and extends outward from a slot 46 on the opposite edge of the wall 44. Each clip has an upper clamping member and a lower clamping member for engagement with a portion of the strip 32. Thus, as shown in FIGS. 3 and 4, clip 38 is provided with an upper clamping member 48 and a lower clamping member 50, which engage recesses 52 and 54 respectively on the upper and lower edges of the strip 32 so that the strip 32 can be removably connected to the band 14. Broken lines 56 and 58 in FIG. 4 illustrate the relative movement of the clip 38 on band 14 in directions indicated by line 60.

When the band 14 is adjusted to fit the helmet by movement of its end portions 16 and 18 relative to the connecting device 20, the clips 38 and 40 can be moved relative to the band 14 so that strip 32 closely fits the exterior of the band 14 as shown in FIG. 1. The strip 32 is fitted to the connecting device 20 by the cooperation of upper and lower clamping members with recesses in the strip 32. These upper and lower clamping members and recesses, which are not shown in the drawings, are similar to the clamping members 48 and 50 and the recesses 52 and 54 shown in FIGS. 3 and 4.

As shown in FIGS. 2 and 3, the connecting device 20 is formed with concave upper and lower edges 56 and 58 for engagement with the convex surface at the rear of helmet 18. When the band is tightened about the helmet, portions of the band fit into a recess in the connecting device between the upper and lower edges 56 and 58.

Although the headlamp and the light emitting devices are preferably operated from the same power source, i.e., the electrochemical power supply located inside the headlamp assembly, the light emitting devices on the strip 32 may be, and preferably are, operable independently of the headlamp. Moreover, multiple modes of illumination may be employed.

In the embodiment shown, the emission of light through lens 28 is controlled by a push-button 62 shown in FIGS. 1-3. This push-button can not only turn the light beam on and off, but can also set brightness levels and establish a flashing mode.

The emission of light through light emitting devices 34 is controlled by a push-button 64 adjacent the end of strip 32 remote from cable 37. This push-button can be used to turn the light emitting devices on and off and can also be used to establish a flashing mode.

Figure 5:
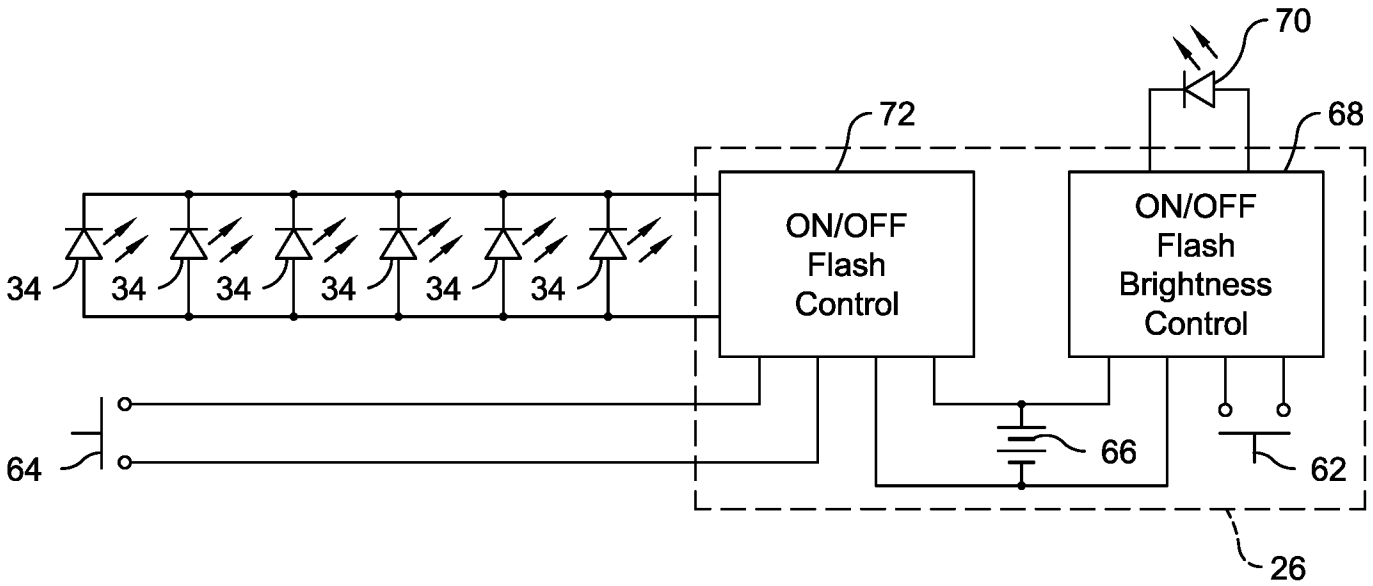
FIG. 5 is an electrical schematic showing the connections of an electrochemical power supply to controls for operating the headlamp and for operating the series of light emitting devices on the flexible strip.

As shown in FIG. 5, the headlamp assembly housing 26, illustrated by a broken line rectangle, contains an electrochemical power supply 66, typically consisting of a two-cell battery. The battery is connected, through an on/off flash and brightness control circuit 68, to a light emitting diode (LED) 70, which serves as the headlamp. The control circuit 66 is operated by push-button switch 62, which, by successive depressions, can turn the LED on in a bright mode, a dimmed mode, and a flashing mode, and then turn the LED off. The light emitting devices 34, which are also preferably light emitting diodes are powered by the same electrochemical power supply 66 through an on/off, flash control circuit 72 by the operation push-button switch 64, which on successive depressions, can turn the light-emitting devices 34 on in a continuous mode, establish a flashing mode, and turn the devices 34 off. Suitable circuits for use as control circuits 68 and 72 are well-known in the field of personal headlamps, and examples can be found in U.S. Pat. No. 8,044,636, granted on Oct. 25, 2011. The disclosure of U.S. Pat. No. 8,044,636 is here incorporated by reference.

What is claimed is:

1. A safety apparatus for use with a helmet comprising:

a headlamp assembly including a housing and a light emitting device mounted in said housing;

a band comprising a loop of flexible material connected to said housing and adapted to surround, at least partially, a helmet worn by an individual, whereby the headlamp assembly can be supported on said helmet, the length of said band being adjustable for tightening said band about said helmet;

an elongated flexible strip having elements from the group consisting of light emitting elements and light reflecting elements, at spaced locations along its length, said elongated flexible strip having a substantially fixed length, extending along a part of the length of said band, and being connected to said band at a plurality of locations along the length of the band, the connection of the elongated strip to said band at least at one of said locations being adjacent an end of said strip and including a connector adjustably movable lengthwise along at least a portion of the length of said band while the housing of said headlamp assembly is in a fixed relationship to said band, so that the substantially fixed length of the elongated flexible strip does not interfere with the tightening of said band about said helmet.

2. The safety apparatus according to claim 1, including a compartment in said housing for containing an electrochemical power supply, and a switch connected to said light emitting device and to said power supply, said switch being manually operable to connect said power supply to said light emitting device.

3. A safety apparatus for use with a helmet comprising:

a headlamp assembly including a housing and a light emitting device mounted in said housing;

a band comprising a loop of flexible material connected to said housing and adapted to surround, at least partially, a helmet worn by an individual, whereby the headlamp assembly can be supported on said helmet, the length of said band being adjustable for tightening said band about said helmet;

an elongated flexible strip having elements from the group consisting of light emitting elements and light reflecting elements, at spaced locations along its length, said elongated flexible strip having a substantially fixed length, extending along a part of the length of said band, and being connected to said band at a plurality of locations along the length of the band, the connection of the elongated strip to said band at least at one of said locations being adjacent an end of said strip and including a connector adjustably movable lengthwise along at least a portion of the length of said band;

a compartment in said housing for containing an electrochemical power supply;

a first switch connected to said light emitting device and to said power supply, said first switch being manually operable to connect said power supply to said light emitting device;

a plurality of light emitting elements supported on said elongated flexible strip and spaced from one another along the length of said elongated flexible strip; and an electrical connection from said plurality of light emitting elements to said electrochemical power supply for supplying electrical current from said power supply to said plurality of light emitting elements, said electrical connection including a second manually operable switch for controlling electrical current from said power supply to said plurality of light emitting elements.

4. A safety apparatus for use with a helmet comprising:

a headlamp assembly including a housing and a light emitting device mounted in said housing;

a band comprising a loop of flexible material connected to said housing and adapted to surround, at least partially, a helmet worn by an individual, whereby the headlamp assembly can be supported on said helmet, the length of said band being adjustable for tightening said band about said helmet; and an elongated flexible strip having elements from the group consisting of light emitting elements and light reflecting elements, at spaced locations along its length, said elongated flexible strip having a substantially fixed length, extending along a part of the length of said band, and being connected to said band at a plurality of locations along the length of the band, the connection of the elongated strip to said band at least at one of said locations being adjacent an end of said strip and including a connector adjustably movable lengthwise along at least a portion of the length of said band;

wherein said connector includes a clip for securing said elongated strip to said connector, said clip allowing manual connection of the elongated flexible strip to said connector.

5. The safety apparatus according to claim 1, wherein said elongated flexible strip is connected to said band by connectors located on said band at locations adjacent, and on opposite sides of, said housing, each of said connectors being adjustably movable lengthwise along at least a portion of the length of said band.

6. A safety apparatus for use with a helmet comprising:

a headlamp assembly including a housing and a light emitting device mounted in said housing;

a band comprising a loop of flexible material connected to said housing and adapted to surround, at least partially, a helmet worn by an individual, whereby the headlamp assembly can be supported on said helmet, the length of said band being adjustable for tightening said band about said helmet;

an elongated flexible strip having elements from the group consisting of light emitting elements and light reflecting elements, at spaced locations along its length, said elongated flexible strip having a substantially fixed length, extending along a part of the length of said band, and being connected to said band at a plurality of locations along the length of the band, the connection of the elongated strip to said band at least at one of said locations being adjacent an end of said strip and including a connector adjustably movable lengthwise along at least a portion of the length of said band; and a plurality of elongated light reflecting elements fixed to said elongated flexible strip at spaced locations along its length.

7. The safety apparatus according to claim 1, including a connecting device, and wherein said band includes first and second portions extending from said headlamp assembly to said connecting device, said first and second portions being adjustably connected to said connecting device whereby the length of said band can be adjusted for tightening said band about said helmet.

8. The safety apparatus according to claim 7, including a compartment in said housing for containing an electrochemical power supply, and a switch connected to said light emitting device and to said power supply, said switch being manually operable to connect said power supply to said light emitting device.

9. The safety apparatus according to claim 7 wherein said elongated flexible strip is connected to said band by connectors located on said band at locations adjacent, and on opposite sides of, said housing, each of said connectors being adjustably movable lengthwise along at least a portion of the length of said band.

10. A safety apparatus for use with a helmet comprising:

a headlamp assembly including a housing, a light emitting device mounted in said housing, a compartment in said housing for containing an electrochemical power supply, and a first switch connected to said light emitting device said first switch being manually operable to connect said power supply to said light emitting device;

a band comprising a loop of flexible material connected to said housing and adapted to surround, at least partially, a helmet worn by an individual, whereby the headlamp assembly can be supported on said helmet;

an elongated flexible strip having a substantially fixed length, extending along a part of the length of said band, and being connected to said band at a plurality of locations along the length of the band, the connection of the elongated strip to said band at least at one of said locations adjacent an end of said strip including a clip allowing disconnection of the elongated strip from said band at least at said one of said locations;

a plurality of light emitting elements mounted on said elongated flexible strip said elements being spaced from one another along the length of said elongated flexible strip; and an electrical connection from said plurality of light emitting elements to said electrochemical power supply, said electrical connection including a second manually operable switch for controlling electrical current from said power supply to said plurality of light emitting elements.

11. The safety apparatus according to claim 10, wherein said clip is adjustably movable along at least a portion of the length of said band.

12. The safety apparatus according to claim 10, wherein said second switch is mounted on said elongated strip.

13. The safety apparatus according to claim 10, wherein said elongated strip includes a plurality of light reflecting elements, at spaced locations along its length.

14. The safety apparatus according to claim 10, wherein the length of said band is adjustable.

15. The safety apparatus according to claim 10, including a connecting device engageable with a rear surface of a helmet, said band including first and second portions extending from said headlamp assembly to said connecting device, said first and second portions being adjustably connected to said connecting device whereby the safety apparatus can be fitted to a helmet.

16. The safety apparatus according to claim 10, including a connecting device engageable with a rear surface of a helmet, said band including first and second portions extending from said headlamp assembly to said connecting device, said first and second portions being adjustably connected to said connecting device whereby the safety apparatus can be fitted to a helmet, and said connecting device including a clip allowing disconnection of the elongated strip from said connecting device.

17. A safety apparatus for use with a helmet comprising:

a headlamp assembly including a housing, a light emitting device mounted in said housing, a compartment in said housing for containing an electrochemical power supply, and a switch connected to said light emitting device said switch being manually operable to connect said power supply to said light emitting device;

a band comprising a loop of flexible material connected to said housing and adapted to surround, at least partially, a helmet worn by an individual, whereby the headlamp assembly can be supported on said helmet;

an elongated flexible strip having a plurality of light reflecting elements, at spaced locations along its length, said elongated flexible strip having a substantially fixed length, extending along a part of the length of said band, and being connected to said band at a plurality of locations along the length of the band, the connection of the elongated strip to said band at least at one of said locations adjacent an end of said strip including a clip allowing disconnection of the elongated strip from said band at least at said one of said locations.

18. The safety apparatus according to claim 17, wherein said clip is adjustably movable along at least a portion of the length of said band.

* * * * *